US010322516B2

(12) United States Patent
Shimizu et al.

(10) Patent No.: US 10,322,516 B2
(45) Date of Patent: Jun. 18, 2019

(54) SLIT BLADE BLOCK AND ELECTRIC RAZOR

(71) Applicant: Panasonic Intellectual Property Management Co., Ltd., Osaka (JP)

(72) Inventors: Hiroaki Shimizu, Shiga (JP); Shunsuke Komori, Shiga (JP); Toshio Ikuta, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/651,528

(22) PCT Filed: Dec. 10, 2013

(86) PCT No.: PCT/JP2013/007263
§ 371 (c)(1),
(2) Date: Jun. 11, 2015

(87) PCT Pub. No.: WO2014/103208
PCT Pub. Date: Jul. 3, 2014

(65) Prior Publication Data

US 2015/0328786 A1 Nov. 19, 2015

(30) Foreign Application Priority Data

Dec. 27, 2012 (JP) ..... 2012-286273

(51) Int. Cl.
*B26B 19/10* (2006.01)
*B26B 19/04* (2006.01)
*B26B 19/42* (2006.01)

(52) U.S. Cl.
CPC ..... *B26B 19/042* (2013.01); *B26B 19/10* (2013.01); *B26B 19/42* (2013.01)

(58) Field of Classification Search
CPC ..... B26B 19/042; B26B 19/10; B26B 19/42
See application file for complete search history.

(56) References Cited

U.S. PATENT DOCUMENTS 2,262,388 A 11/1941 Dalkowitz
2,325,267 A 7/1943 Murphy
2,725,625 A 12/1955 Muntz
(Continued)

FOREIGN PATENT DOCUMENTS

CN 101107104 A 1/2008
DE 4413352 C1 5/1995
(Continued)

OTHER PUBLICATIONS

Chinese Office Action issued in Chinese Application No. 201380067713.3 dated Jan. 3, 2016.
(Continued)

*Primary Examiner* — Kenneth E Peterson
*Assistant Examiner* — Liang Dong
(74) *Attorney, Agent, or Firm* — McDermott Will & Emery LLP

(57) ABSTRACT

A slit blade block is provided with a slit outer blade, a comb component, and an outer blade connector to which the slit outer blade is fixed. The comb component is sandwiched between and held by the slit outer blade and the outer blade connector when the slit outer blade is fixed to the slit connector.

5 Claims, 11 Drawing Sheets

(56) References Cited

U.S. PATENT DOCUMENTS

| | | | | |
|---|---|---|---|---|
| 3,290,775 | A | 12/1966 | Tolmie | |
| 3,517,441 | A * | 6/1970 | Fritschy | B26B 19/04 30/34.1 |
| 5,802,932 | A | 9/1998 | Vankov et al. | |
| 6,178,641 | B1 | 1/2001 | Meijer | |
| 6,684,509 | B1 * | 2/2004 | Best | B26B 19/102 30/34.1 |
| 2005/0274019 | A1 | 12/2005 | Inoue et al. | |
| 2006/0225290 | A1 * | 10/2006 | Bader | B26B 19/042 30/346.51 |
| 2008/0005906 | A1 | 1/2008 | Franke et al. | |

FOREIGN PATENT DOCUMENTS

| | | | | |
|---|---|---|---|---|
| FR | 2442111 | A1 | 6/1980 | |
| JP | 2002-515315 | A | 5/2002 | |
| JP | 2006-247144 | A | 9/2006 | |
| JP | 2007-506492 | A | 3/2007 | |
| JP | 2008-000296 | A | 1/2008 | |
| JP | 2008-005983 | A | 1/2008 | |
| JP | WO 2012124459 | A1 * | 9/2012 | B26B 19/02 |
| JP | 2012-192094 | A | 10/2012 | |
| WO | 99/28099 | A1 | 6/1999 | |

OTHER PUBLICATIONS

International Search Report issued in PCT/JP2013/007263, dated Jan. 28, 2014, with English translation.

English Translation of International Preliminary Report on Patentability issued in International Application No. PCT/JP2013/007263 dated Jun. 30, 2015.

* cited by examiner

SLIT BLADE BLOCK AND ELECTRIC RAZOR

RELATED APPLICATIONS

This application is the U.S. National Phase under 35 U.S.C. § 371 of International Application No. PCT/JP2013/007263, filed on Dec. 10, 2013, which in turn claims the benefit of Japanese Application No. 2012-286273, filed on Dec. 27, 2012, the disclosures of which Applications are incorporated by reference herein.

TECHNICAL FIELD

The present invention relates to a slit blade block.

BACKGROUND ART

As shown in FIG. 11, a conventional slit blade block 200 includes a slit outer blade 210, outer blade connectors 220, and a comb component 230. The slit blade block 200 is accommodated in an outer blade case 240. The slit outer blade 210 is coupled to the outer blade connectors 220. The outer blade connectors 220 include links 221 on two opposite ends. Each link 221 may be a bent projection. Each link 221 includes an arm 222 extending upward. The comb component 230 is a polygonal tube opening upward.

As shown in FIG. 12, the comb component 230 includes an inner void, in which the slit outer blade 210 and the outer blade connectors 220 are accommodated. The comb component 230 includes two opposite end walls 231, each of which includes a slit 232.

The arms 222 of the outer blade connectors 220 are accommodated in the slits 232 of the comb component 230 and engaged with the comb component 230. In this manner, the slit outer blade 210 and the outer blade connectors 220 are elastically supported by the comb component 230. Patent document 1 describes an example of a conventional slit blade block.

PRIOR ART DOCUMENT

Patent Document

Patent Document 1: Japanese National Phase Laid-Open Patent Publication No. 2002-515315

SUMMARY OF THE INVENTION

In the slit blade block 200, when the arms 222 of the outer blade connectors 220 are elastically deformed, an assembly of the slit outer blade 210 and the outer blade connectors 220 may move or vibrate relative to the comb component 230.

It is an object of the present invention to provide a slit blade block in which a slit outer blade, a comb component, and an outer blade connector are fixed in a stable manner.

One aspect of the present invention provides a slit blade block of an electric razor that includes a slit outer blade including a plurality of blade pieces, a comb component including a plurality of comb teeth adjacent to the blade pieces, and an outer blade connector, to which the slit outer blade is fixed. The comb component is held between the slit outer blade and the outer blade connector with the slit outer blade fixed to the outer blade connector.

In this structure, when the slit outer blade is fixed to the outer blade connector, the slit outer blade and the outer blade connector hold the comb component in between. This prevents or limits movement of the comb component and the slit outer blade and movement of the comb component and the outer blade connector. Thus, the slit blade block may include the slit outer blade, the comb component, and the outer blade connector, which are fixed stably.

In one example, the slit outer blade includes a slit fixing portion. The outer blade connector includes a connector fixing portion, which is coupled to the slit fixing portion of the slit outer blade so that the slit outer blade is fixed to the outer blade connector. The slit fixing portion and the connector fixing portion are located below a lower end surface of the comb component.

In one example, the blade pieces are laid out in a layout direction. The comb component is held between the slit outer blade and the outer blade connector in the layout direction and a heightwise direction.

In one example, the blade pieces are laid out in a layout direction. The comb component includes a projection that projects from an end portion of the comb component in the layout direction. The projection is held between the slit outer blade and the outer blade connector in a heightwise direction.

In one example, the blade pieces are laid out in a layout direction. The comb component is held between the slit outer blade and the outer blade connector in the layout direction and a depth direction that is orthogonal to the layout direction.

Another aspect of the present invention provides an electric razor that includes the above slit blade block.

EMBODIMENTS OF THE INVENTION

Figure 1:
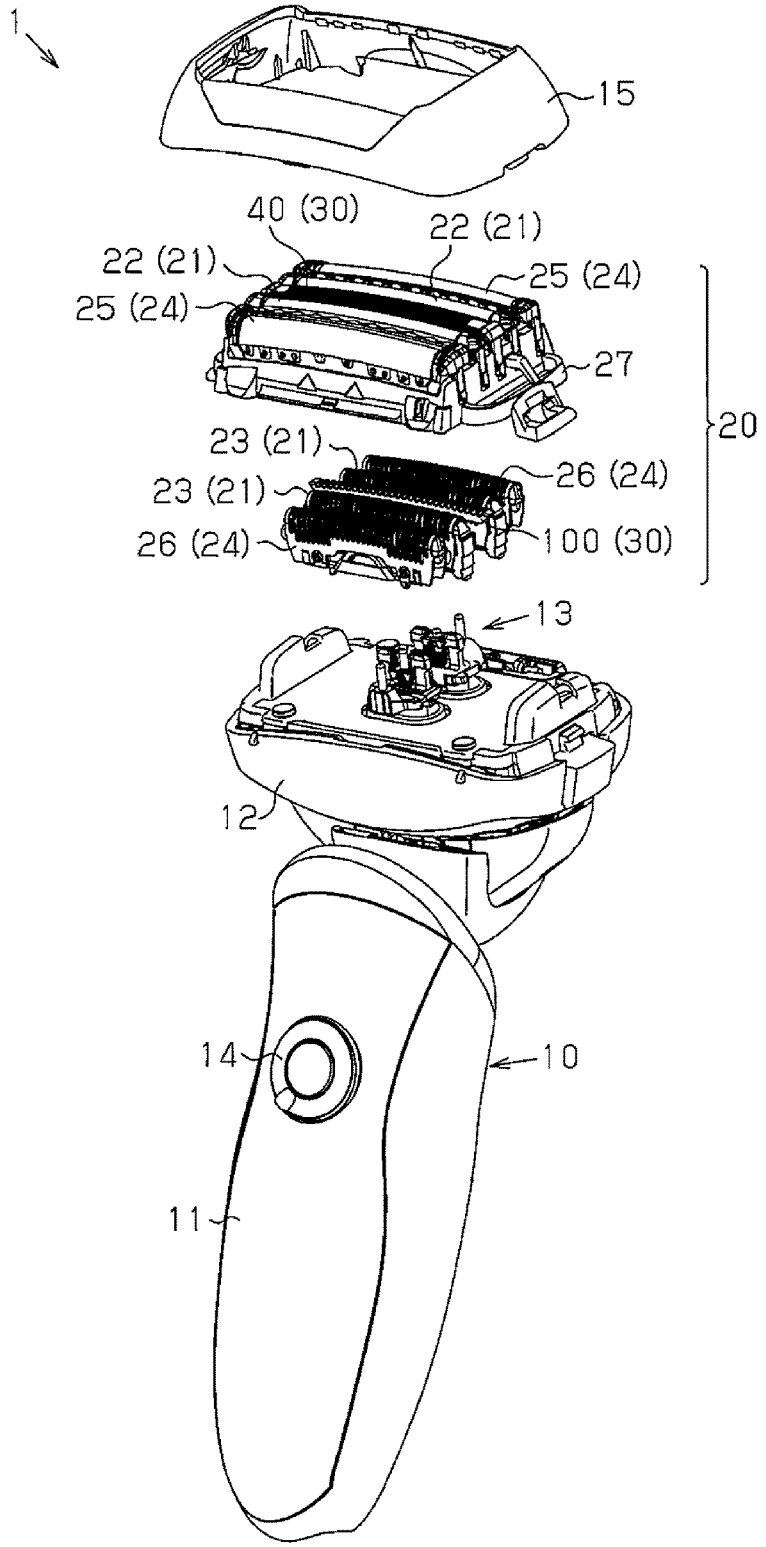
FIG. 1 is an exploded perspective view of one embodiment of an electric razor.

Referring to FIG. 1, an electric razor 1 will now be described. The electric razor 1 includes a razor body 10 and a blade unit 20.

The razor body 10 includes a grip 11, a head 12, a driver 13, a power supply switch 14, and a head cover 15. The head 12 is coupled to the grip 11. The grip 11 and head 12 accommodate the driver 13. The driver 13 includes a portion projecting from the head 12 to an outer side. The driver 13 reciprocally moves the blade unit 20. The power supply switch 14 is located on the grip 11. The head cover 15 is attached to the head 12.

The head cover 15 covers a peripheral portion of the blade unit 20. The blade unit 20 includes two first blade blocks 21, two second blade blocks 24, a slit blade block 30, and an outer blade case 27. The two first blade blocks 21 are located at opposite sides of the slit blade block 30. Each second blade block 24 and the slit blade block 30 are located at opposite sides of one of the first blade blocks 21. The outer blade case 27 holds the first blade blocks 21, the second blade blocks 24, and the slit blade block 30. The outer blade case 27 is attached to the head 12.

Each first blade block 21 includes a first net blade 22 and a first inner blade 23. Each first net blade 22 accommodates the corresponding first inner blade 23. The driver 13 reciprocally moves the first inner blades 23 in the first net blades 22.

Each second blade block 24 includes a second net blade 25 and a second inner blade 26. Each second net blade 25 accommodates the corresponding second inner blade 26. The driver 13 reciprocally moves the second inner blades 26 relative to the second net blades 25. In this manner, the electric razor 1 may be a reciprocal motion electric razor that reciprocally moves the inner blades 23, 26 relative to the net blades 22, 25.

The blade unit 20 will now be described. The first blade blocks 21 function to mainly remove lying whiskers (hair). The second blade blocks 24 function to mainly remove short standing whiskers (hair). The slit blade block 30 functions to mainly remove long whiskers (hair).

The slit blade block 30 will now be described with reference to FIG. 2. In the description hereafter, upper and lower positions are defined with reference to the position of the electric razor 1 shown in FIG. 1.

The slit blade block 30 includes a slit outer blade 40, a comb component 60, two outer blade connectors 90, a slit inner blade 100, an inner blade connector 110, and two coil springs 31. The slit blade block 30 is connected to the driver 13 (refer to FIG. 1) by the inner blade connector 110.

The slit outer blade 40 is formed by a metallic material. The slit outer blade 40 may be formed, for example, by pressing. The slit outer blade 40 includes an upper plane virtually connecting upper surfaces of blade pieces 41. The upper plane is bulged upward. The slit outer blade 40 includes a lower opening that receives the slit inner blade 100. The slit outer blade 40 includes the blade pieces 41, slits 42, two links 43, and two slit bodies 50. The slit outer blade 40 may be a single component entirely formed from the same material. The blade pieces 41 are laid out in a layout direction, which is indicated by the arrow ZA. The layout direction ZA may be a direction in which the slit inner blade 100 moves, a longitudinal direction of the slit blade block 30, and a widthwise direction of the electric razor 1.

The comb component 60 is formed from a resin material. The comb component 60 may be, for example, injection-molded. The comb component 60 includes an upper opening that receives the slit outer blade 40. In the illustrated example, the comb component 60 is frame-shaped as viewed from above. In an example, the comb component 60 is slightly bulged upward. The comb component 60 includes two comb walls 70, two comb end walls 80, and four insertion portions 61. The comb component 60 may be a single component entirely formed from the same material.

Each outer blade connector 90 is formed from a resin material. Each outer blade connector 90 may be, for example, injection-molded. Each outer blade connector 90 includes a connector body 91, a seat 92, a projection 93, an accommodation hole 94, two first welding portions 95, two second welding portions 96, and a spring attachment 97. The projection 93 and the accommodation hole 94 may be part of the seat 92. The outer blade connector 90 may be a single component entirely formed from the same material. The first welding portions 95 and the second welding portions 96 each correspond to a connector fixing portion.

The slit inner blade 100 is formed from a metallic material. The slit inner blade 100 may be formed, for example, by pressing. The slit inner blade 100 includes two slit bodies 101, blade pieces 102, and slits 103. The slit inner blade 100 may be a single component entirely formed from the same material.

Each slit body 101 includes two positioning portions 104 and two weld fixing portions 105. The slit bodies 101 are connected to each other by the blade pieces 102. Each positioning portion 104 may be a recess that opens downward. Each weld fixing portion 105 may include two arms extending downward. In the illustrated example, each weld fixing portion 105 is located between one of the positioning portions 104 and the middle, in the widthwise direction ZA, of the corresponding slit body 101.

The blade pieces 102 are arranged at predetermined pitches, which correspond to the slits 103. Each blade piece 102 is, for example, U-shaped.

The inner blade connector 110 is formed from a resin material. The inner blade connector 110 may be, for example, injection-molded. The inner blade connector 110 includes a connector body 111, a drive fitting portion 112, four positioning portions 113, four welding portions 114, and two spring attachments 115. The inner blade connector 110 may be a single component entirely formed from the same material.

The drive fitting portion 112 is located in the middle, in the widthwise direction ZA, of the connector body 111. The positioning portions 113 are located between the drive fitting portion 112 and ends, in the widthwise direction ZA, of the connector body 111. The positioning portions 113 project from outer surfaces of the connector body 111 in the depth direction ZB. The welding portions 114 are located proximate to the middle, in the widthwise direction ZA, of the connector body 111. The welding portions 114 project from the outer surfaces of the connector body 111 in the depth direction ZB. The spring attachments 115 are located at the ends, in the widthwise direction ZA, of the connector body 111 and project downward.

The slit outer blade 40 will now be described with reference to FIG. 2.

The blade pieces 41 are arranged between the links 43 at predetermined pitches, which correspond to the slits 42. Each blade piece 41 is, for example, U-shaped. Each slit 42 extends in the depth direction ZB. Whiskers (hair) are guided into the slits 42.

Figure 8A:
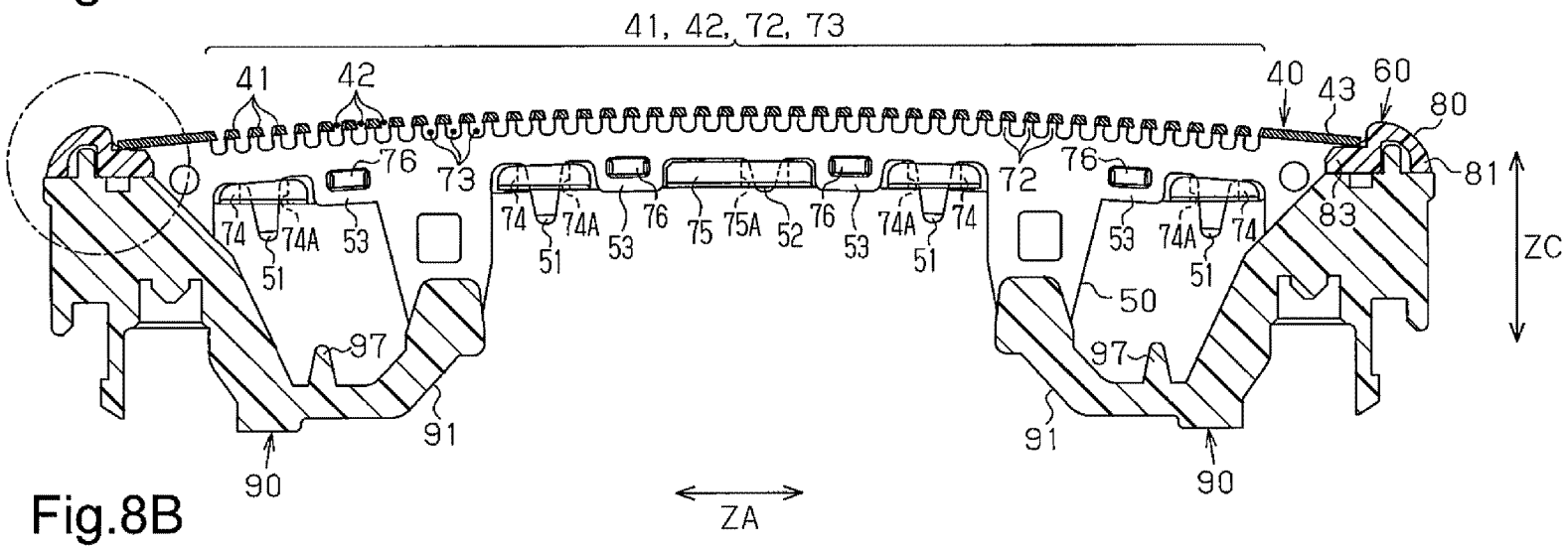
FIG. 8A is a schematic cross-sectional view of the slit blade block taken along line Z6-Z6 of FIG. 6, and FIGS. 8B and 8C are partially enlarged views of FIG. 8A.

The links 43 are located at two opposite ends, in the widthwise direction ZA, of the slit outer blade 40. As shown in FIG. 8A, the links 43 are plate-like and slightly inclined so that the links 43 are sloped upward toward the middle, in the widthwise direction ZA, of the slit outer blade 40.

Each slit body 50 is formed by a wall that is parallel in the widthwise direction ZA and the heightwise direction ZC. Each slit body 50 includes four first claws 51, one second claw 52, four fitting portions 53, two first weld fixing portions 54, and two second weld fixing portions 55. The slit bodies 50 are connected to each other by the blade pieces 41 and the links 43. Each slit body 50 is coupled to the comb component 60 at the first claws 51, the second claw 52, and the fitting portions 53. Each slit body 50 is coupled to the outer blade connector 90 at the first weld fixing portions 54 and the second weld fixing portions 55. The first weld fixing portions 54 and the second weld fixing portions 55 each correspond to a slit fixing portion.

The first weld fixing portions 54 are located at the ends, in the widthwise direction ZA, of each slit body 50. Each second weld fixing portion 55 is located between one of the first weld fixing portions 54 and the middle, in the widthwise direction ZA, of the corresponding slit body 50.

Each first claw 51 is tapered so that the size in the widthwise direction ZA decreases toward the lower end. The lower end surface of each first claw 51 is, for example, curved. The first claws 51 are separated from one another. For example, some of the first claws 51 are located between a first weld fixing portion 54 and a second weld fixing portion 55. The other first claws 51 are arranged between the second weld fixing portions 55.

Each second claw 52 is tapered so that the size in the widthwise direction ZA decreases toward the lower end. The lower end surface of each second claw 52 is, for example, curved. Each second claw 52 is located in the middle, in the widthwise direction ZA, of the corresponding slit body 50. The second claws 52 are shorter than the first claws 51.

The fitting portions 53 are separated from one another in the widthwise direction ZA. For example, some of the fitting portions 53 are adjacent to the outer edge, in the widthwise direction ZA, of a second weld fixing portion 55. The other fitting portions 53 are located between a first claw 51 and a second claw 52. Each fitting portion 53 includes a through hole 53A extending in the depth direction ZB through the corresponding slit body 50.

The outer blade connectors 90 will now be described with reference to FIG. 2.

Each seat 92 includes an upper surface, which may be flat. The upper surface of each seat 92 is, for example, T-shaped. Each seat 92 is located at the outer, in the widthwise direction ZA, and upper end of the corresponding connector body 91. Each seat 92 includes an outer seat 92A and an inner seat 92B. The upper surface of the outer seat 92A is flush with the upper surface of the inner seat 92B. The outer seat 92A is greater than the inner seat 92B in the size in the depth direction ZB.

Each projection 93 may be rectangular the size of which is greater in the depth direction ZB than in the widthwise direction ZA. Each projection 93 projects upward from the corresponding outer seat 92A.

Each inner seat 92B includes an accommodation hole 94. Each accommodation hole 94 is adjacent to the corresponding projection 93 in the widthwise direction ZA. Each accommodation hole 94 extends downward from the upper surface of the corresponding inner seat 92B.

Each first welding portion 95 is tubular. Each first welding portion 95 is located on or proximate to the outer end, in the widthwise direction ZA, of the corresponding the connector body 91. The first welding portions 95 project from outer surfaces of the corresponding connector body 91 in the depth direction ZB.

Each second welding portion 96 is tubular. Each second welding portion 96 is located on the inner end, in the widthwise direction ZA, of the connector body 91. The second welding portions 96 project from the outer surfaces of the corresponding connector body 91 in the depth direction ZB.

Each spring attachment 97 is located between a first welding portions 95 and the corresponding second welding portion 96 in the widthwise direction ZA. Each spring attachment 97 includes a projection projecting upward from the corresponding connector body 91. The projections may each be circular cone-shaped.

The comb component 60 will now be described with reference to FIGS. 2 to 4.

Figure 3:
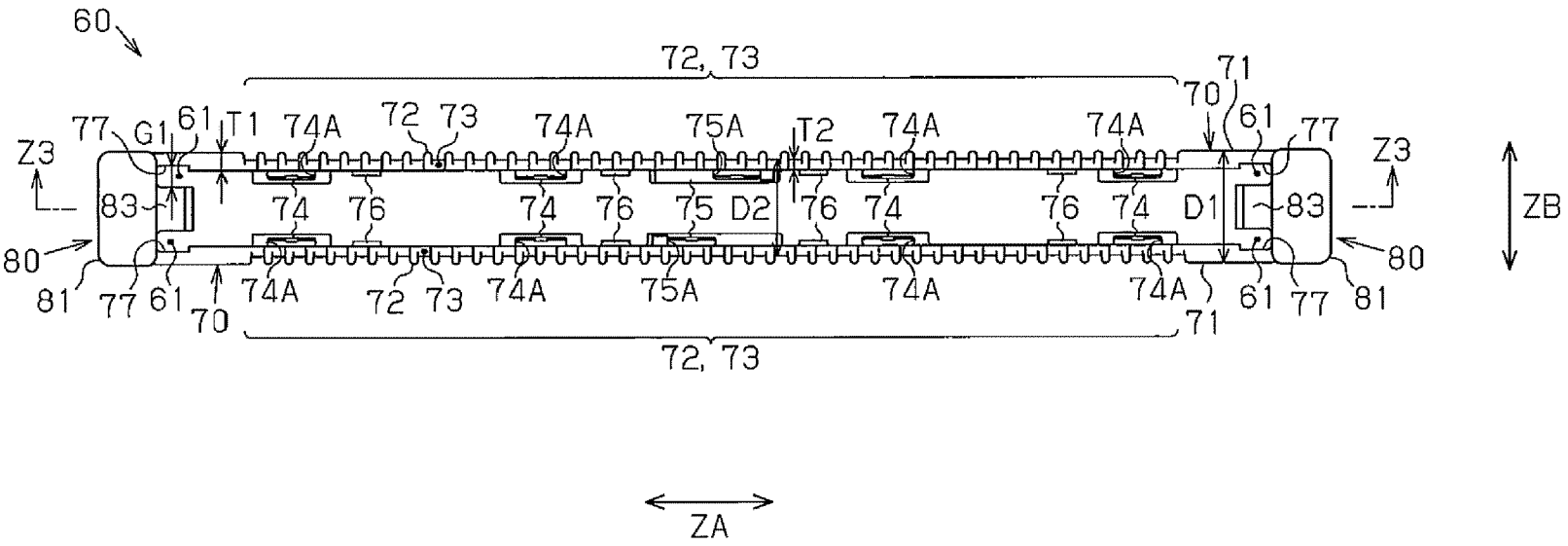
FIG. 3 is a plan view of the comb component.

As shown in FIG. 3, in the comb component 60, the depth distance D1 at the end, in the widthwise direction ZA, of the comb walls 70 is greater than the depth distance D2 at the middle, in the widthwise direction ZA, of the comb walls 70.

Each comb wall 70 includes a comb wall body 71, comb teeth 72, slits 73, four first receptacles 74, one second receptacle 75, four positioning portions 76, and two recesses 77. Each comb wall 70 is a single element entirely formed from the same material.

Figure 4:
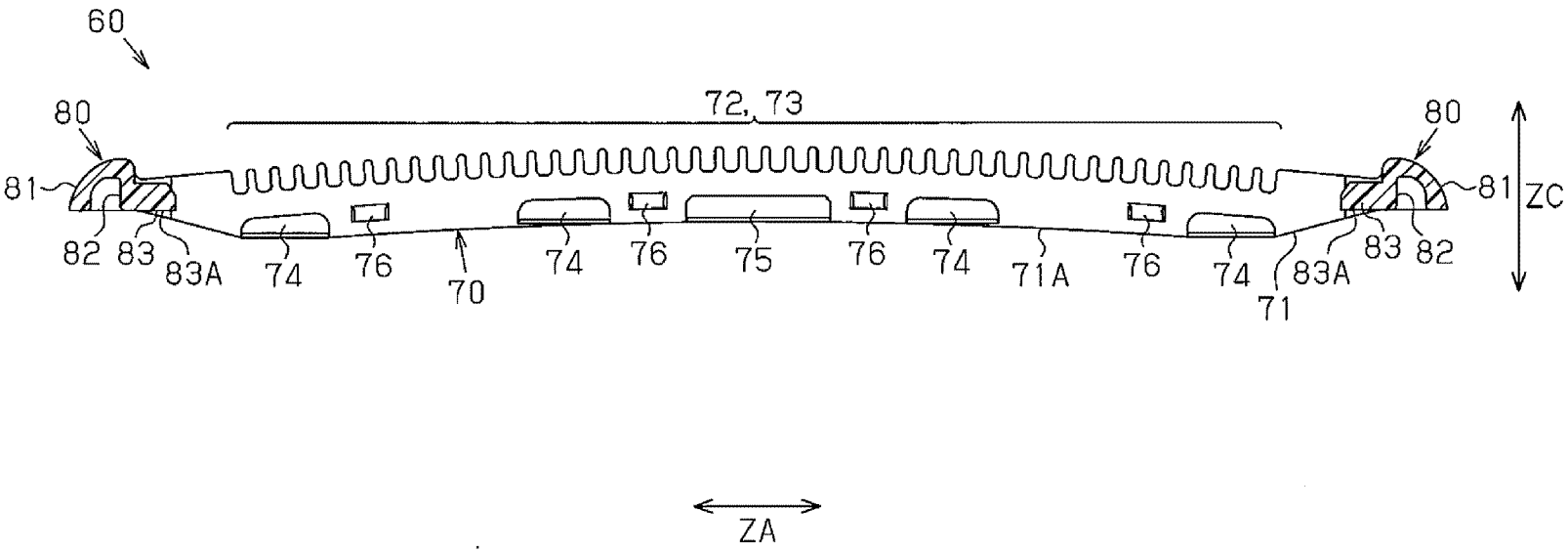
FIG. 4 is a cross-sectional view of the comb component taken along line Z3-Z3 of FIG. 3.

Each comb wall body 71 extends in the widthwise direction ZA and is slightly curved upward (refer to FIG. 4). The thickness T1 of an end, in the widthwise direction ZA, of each comb wall body 71 is greater than the thickness T2 of the middle, in the widthwise direction ZA, of the comb wall body 71.

The comb teeth 72 are arranged on an upper portion of each comb wall body 71. The comb teeth 72 are arranged in the widthwise direction ZA at predetermined pitches, which correspond to the slits 73. The slits 73 guide whiskers (hair) together with the slits 42 of the slit outer blade 40 (refer to FIG. 2). In the illustrated example, the comb teeth 72 each project outward from the corresponding comb wall body 71.

Figures 2A, 2B:
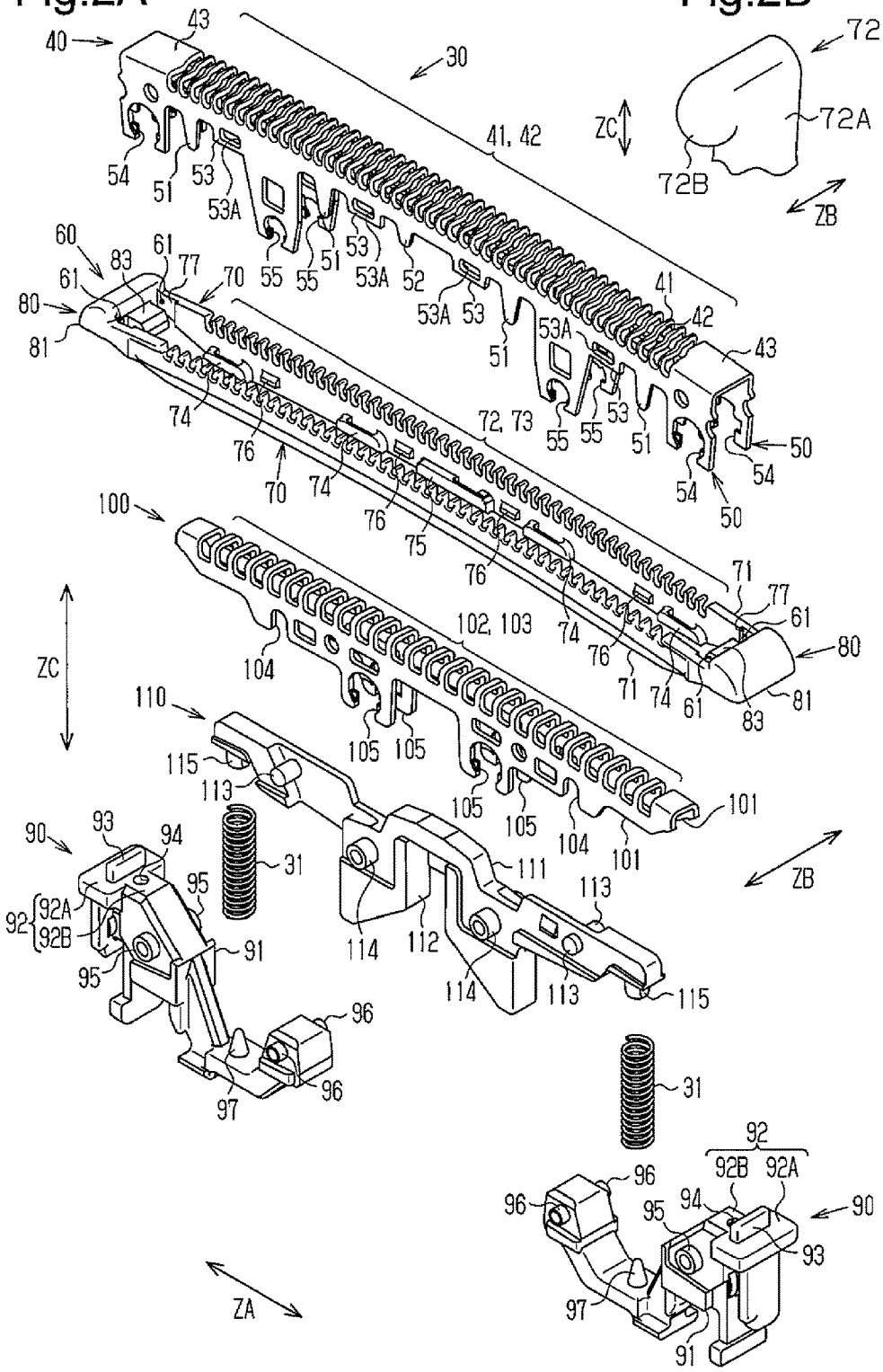
FIG. 2A is an exploded perspective view of a slit blade block.
FIG. 2B is an enlarged perspective view of a comb tooth of a comb component.

As shown in FIG. 2B, each comb tooth 72 includes a base 72A and a tip 72B. Each comb tooth 72 is a single element entirely formed from the same material. The base 72A is rod-shaped and extends in the heightwise direction ZC. The tip 72B includes a distal surface, which is curved or hemispherical. The tip 72B projects outward in the depth direction ZB from an upper portion of the base 72A. Each comb wall body 71 functions to guide whiskers (hair) to the slits 42 of the slit outer blade 40.

The first receptacles 74 are separated from one another in the widthwise direction ZA. Each first receptacle 74 projects from the inner surface of the corresponding comb wall body 71. Each first receptacle 74 includes a through hole 74A extending in the heightwise direction ZC. The first receptacles 74 include two outermost first receptacles 74, which are located at positions corresponding to two opposite ends of the row of the comb teeth 72.

Each second receptacle 75 is located at the middle, in the widthwise direction ZA, of the corresponding comb wall body 71. Each second receptacle 75 projects from the inner surface of the corresponding comb wall body 71. Each second receptacle 75 includes a through hole 75A extending in the heightwise direction ZC. The second receptacles 75 are greater than the first receptacles 74 in the size in the widthwise direction ZA.

The positioning portions 76 are separated from one another in the widthwise direction ZA. The positioning portions 76 are located proximate to the first receptacles 74. In the illustrated example, locations between two adjacent first receptacles 74 each include a positioning portion 76. Also, locations between a first receptacle 74 and a second receptacle 75 each include a positioning portion 76. Each positioning portion 76 may be a projection piece projecting from the inner surface of the corresponding comb wall body 71.

The recesses 77 are located at two opposite ends, in the widthwise direction ZA, of each comb wall 70. Each recess 77 is adjacent to the corresponding comb end wall 80. Each recess 77 forms a step between the inner surface of the corresponding comb wall 70 and the corresponding comb end wall 80.

As shown in FIG. 4, each comb end wall 80 includes an end wall body 81, a receptacle 82, and a projection 83. Each comb end wall 80 is a single element entirely formed from the same material. The end wall body 81 of each comb end wall 80 is connected to an end, in the widthwise direction ZA, of the corresponding comb wall body 71.

Each end wall body 81 may include a surface that is smoothly curved upward. The uppermost end of each end wall body 81 is located above the comb wall bodies 71.

Each receptacle 82 may be a recess formed in a lower surface of the corresponding end wall body 81 and extending upward.

Each projection 83 is located in the upper opening of the comb component 60. Each projection 83 is located below an upper end of the corresponding end wall body 81 and projects toward the middle of the comb component 60. In the illustrated example, each projection 83 includes a flat upper surface, which is parallel in the width direction ZA and the depth direction ZB, and side surfaces, which are opposed to the corresponding recesses 77 of the comb walls 70 (refer to FIG. 3). The upper surface of each projection 83 may be, for example, tetragonal (refer to FIG. 3).

When injection-molding the comb component 60, the gate of a mold, into which a molding material flows, is located at a lower surface 83A of a projection 83. Thus, the lower surface 83A of the projection 83 includes a cut portion 83B (refer to FIG. 9). The cut portion 83B is formed when the comb component 60 is cut away from the mold gate to become a mold component. The cut portion 83B projects downward from the lower surface 83A of the projection 83.

As shown in FIG. 3, voids surrounded by an end wall body 81, a projection 83, and a comb wall body 71 are each defined in an insertion portion 61. The insertion portions 61 are located at opposite sides of each projection 83 in the depth direction ZB. Each insertion portion 61 has size G1 in the depth direction ZB that is greater than the size, in the depth direction ZB, (thickness) of a slit body 50 of the slit outer blade 40.

The slit blade block 30 will now be described with reference to FIGS. 2, 5, and 6.

Figure 5:
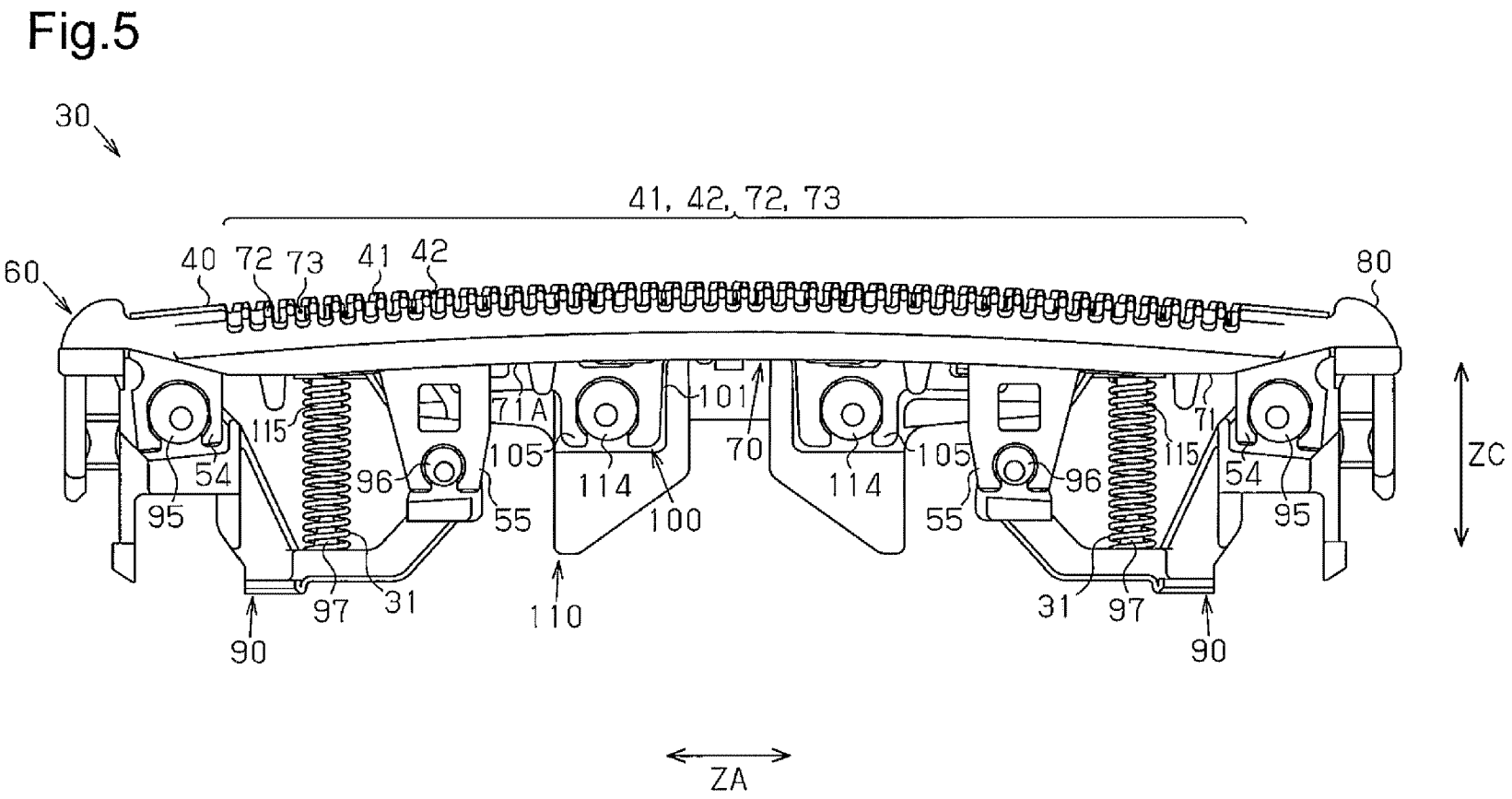
FIG. 5 is a front view of the slit blade block.

As shown in FIG. 5, in the slit blade block 30, the slit outer blade 40, the comb component 60, the outer blade connectors 90, the slit inner blade 100, the inner blade connector 110, and the coil springs 31 are coupled together. In this situation, the weld fixing portions 54, 55 of the slit outer blade 40 and the welding portions 95, 96 of the outer blade connectors 90 each project downward beyond lower surfaces 71A of the comb wall bodies 71 of the comb walls 70. Additionally, the weld fixing portions 105 of the slit inner blade 100 and the welding portions 114 of the inner blade connector 110 project downward beyond the lower surfaces 71A of the comb wall bodies 71. Each lower surface 71A corresponds to an end surface located at a side of the comb component that is opposite to the comb teeth.

The first weld fixing portions 54 of the slit outer blade 40 engage the first welding portions 95 of the outer blade connectors 90. The first welding portions 95 are welded to the first weld fixing portions 54 by heat sealing. This fixes the slit outer blade 40 to the outer blade connectors 90. The second welding portions 96 of the outer blade connectors 90 engage the second weld fixing portions 55 of the slit outer blade 40. The second welding portions 96 are welded to the second weld fixing portions 55 by heat sealing. This fixes the slit outer blade 40 to the outer blade connectors 90.

The inner blade connector 110 is accommodated between the two slit bodies 101 of the slit inner blade 100. When the positioning portions 113 (refer to FIG. 2) are in contact with the positioning portions 104 of the slit inner blade 100 (refer to FIG. 2), the inner blade connector 110 is positioned relative to the slit inner blade 100. The welding portions 114 of the inner blade connector 110 are fixed to the weld fixing portions 105 by heat sealing. Thus, the slit inner blade 100 is fixed to the inner blade connector 110. The slit inner blade 100 is accommodated in the slit outer blade 40.

In the slit blade block 30, the coil springs 31 connect the inner blade connector 110 and the outer blade connectors 90. The upper portions of the coil springs 31 are attached to the spring attachments 115 of the inner blade connector 110. The lower portions of the coil springs 31 are attached to the spring attachments 97 of the outer blade connectors 90. The coil springs 31 are continuously compressed by the inner blade connector 110 and the outer blade connectors 90.

Figure 6:
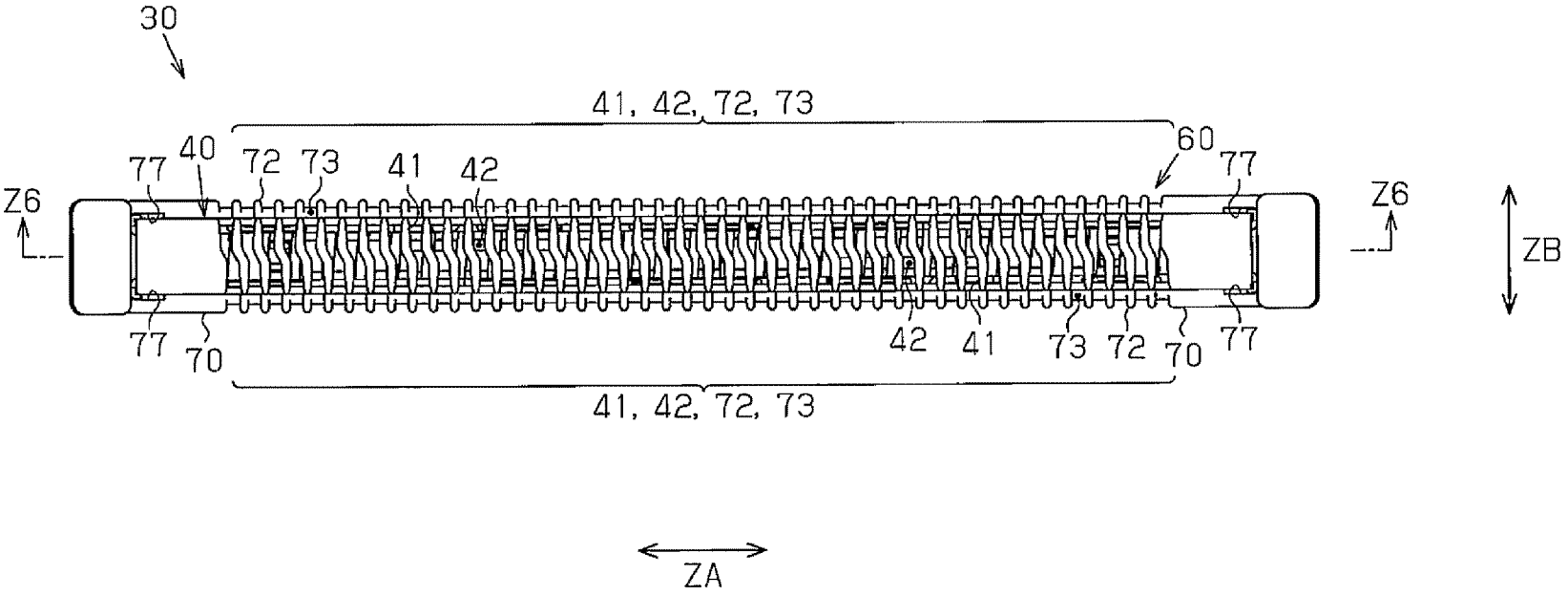
FIG. 6 is a plan view of the slit blade block.

As shown in FIG. 6, the comb component 60 surrounds the slit outer blade 40. The comb teeth 72 are adjacent to the blade pieces 41 in the depth direction ZB. The pitch of the comb teeth 72 is the same as the pitch of the blade pieces 41. The slits 73 of the comb component 60 are in communication with the slits 42 of the slit outer blade 40.

The inner surfaces of the comb walls 70 are in contact with the outer surfaces of the slit bodies 50 of the slit outer blade 40 (refer to FIG. 2). The recesses 77 of the comb walls 70 are opposed to the outer surfaces of the slit bodies 50 of the slit outer blade 40 with gaps located in between.

The process for coupling the slit outer blade 40, the comb component 60, and the outer blade connectors 90 will now be described with reference to FIGS. 5 and 7 to 9.

The coupling process of the slit blade block 30 includes a comb tentative coupling process, a connector tentative coupling process, and a fixing process. In the comb tentative coupling process, the slit outer blade 40 and the comb component 60 are tentatively coupled. In the connector tentative coupling process, the tentatively coupled assembly of the slit outer blade 40 and the comb component 60 is tentatively coupled to the outer blade connectors 90. In the fixing process, the slit outer blade 40 is fixed to the outer blade connectors 90.

Figure 7:
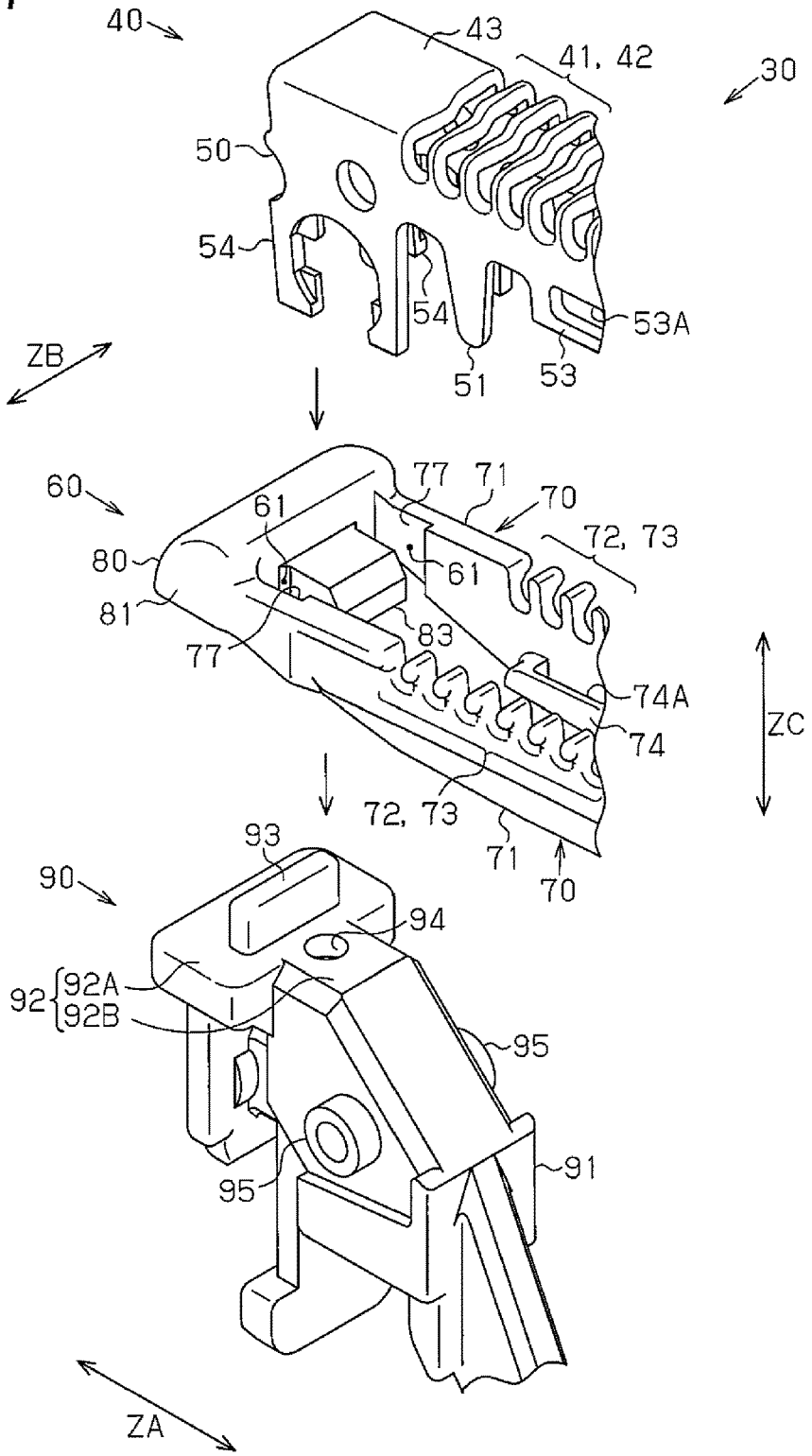
FIG. 7 is a partially perspective view of a slit outer blade, the comb component, and an outer blade connector.

The comb tentative coupling process will now be described. As shown in FIG. 7, the slit outer blade 40 is inserted into the comb component 60 from above. In this case, the first weld fixing portions 54 of the slit outer blade 40 are inserted into the insertion portions 61 of the comb component 60. When inserted into the insertion portions 61 of the comb component 60, walls of the slit outer blade 40 are in contact with the projection 83 of the comb end wall 80 and the comb wall bodies 71 of the comb walls 70 or opposed to the projection 83 of the comb end wall 80 and the comb wall bodies 71 of the comb walls 70 with slight gaps located in between. This prevents or limits movement of the slit outer blade 40 relative to the comb component 60 in the depth direction ZB.

Figure 8C:
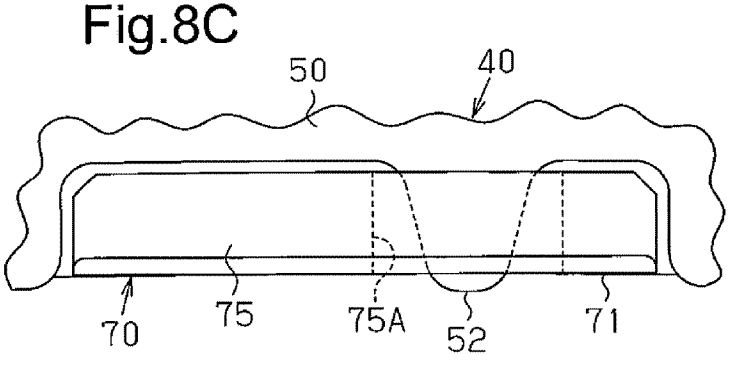
Figure 8B:
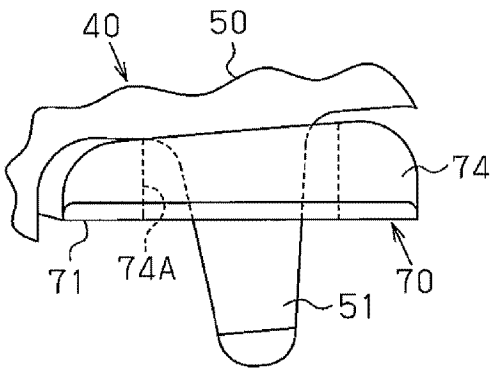

As shown in FIG. 8, the links 43 of the slit outer blade 40 are placed on the upper surfaces of the projections 83 of the comb end walls 80. In this situation, the two opposite end surfaces, in the widthwise direction ZA, of the slit outer blades 40 are in contact with the comb end walls 80 or opposed to the comb end walls 80 with slight gaps located in between. This prevents or limits movement of the slit outer blade 40 in the widthwise direction ZA relative to the comb component 60.

The first claws 51 of the slit outer blade 40 are inserted into the through holes 74A of the first receptacles 74. The second claws 52 of the slit outer blade 40 are inserted into the through holes 75A of the second receptacles 75. The fitting portions 53 of the slit outer blade 40 are fitted to the positioning portions 76. In this manner, the slit outer blade 40 and the comb component 60 are tentatively coupled.

The connector tentative coupling process will now be described.

Figure 9:
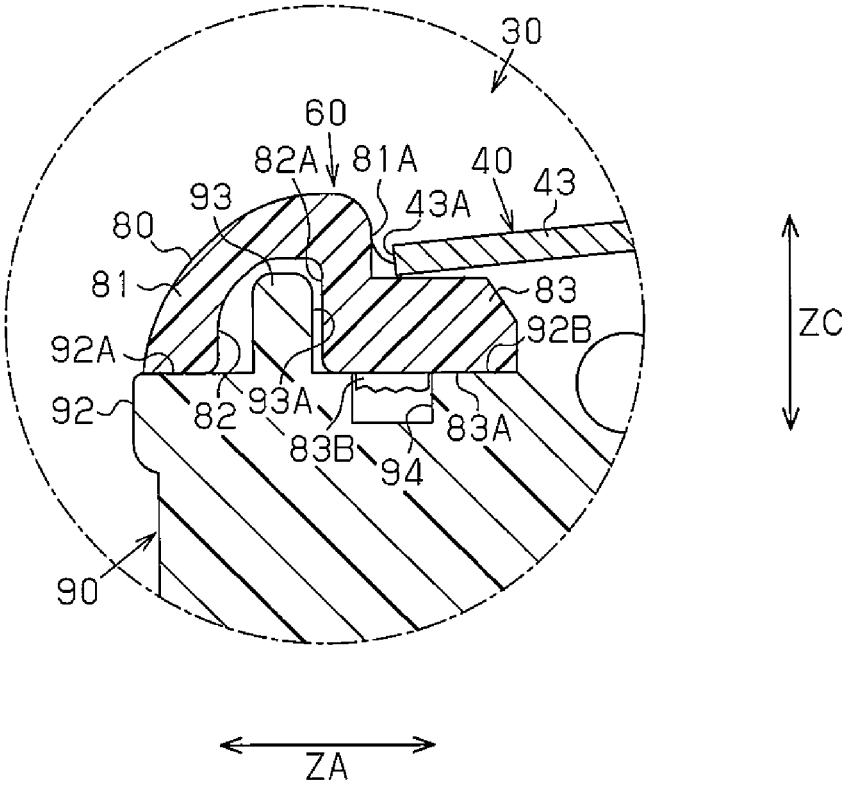
FIG. 9 is a partially enlarged view of the slit blade block corresponding to a dashed circle of FIG. 8A.

As shown in FIG. 9, the end wall body 81 of the comb end wall 80 of the comb component 60 includes a lower surface that is in contact with an upper surface of the seat 92 (outer seat 92A) of the outer blade connector 90. The projection 83 of the comb end wall 80 of the comb component 60 includes the lower surface 83A that is in contact with an upper surface of the seat 92 (inner seat 92B). In this situation, the cut portion 83B of the projection 83 is accommodated in the accommodation hole 94 of the outer blade connector 90.

In this manner, the comb component 60 (projection 83) is held between the slit outer blade 40 and the outer blade connector 90 in the heightwise direction ZC. This prevents or limits movement of the comb component 60 in the heightwise direction ZC relative to the slit outer blade 40 and the outer blade connector 90.

When the projection 93 of the outer blade connector 90 is inserted into the receptacle 82 of the comb component 60, an inner surface 82A of the receptacle 82 is opposed to side surfaces 93A of the projection 93 with a slight gap located in between. The end wall body 81 of the comb component 60 includes an end surface 81A that is opposed to a side surface 43A of the link 43 of the slit outer blade 40 with a slight gap located in between. Thus, the comb component 60 is sandwiched between the projection 93 of the outer blade connector 90 and the link 43 of the slit outer blade 40 in the widthwise direction ZA. This prevents or limits movement of the comb component 60 in the widthwise direction ZA relative to the slit outer blade 40 and the outer blade connector 90. In this manner, the slit outer blade 40, the comb component 60, and the outer blade connectors 90 are tentatively coupled. In the connector tentative coupling process, the slit inner blade 100, the inner blade connector 110, and the two coil springs 31 are integrated with the outer blade connectors 90 (refer to FIG. 5).

The fixing process will now be described.

In the assembly, which is tentatively coupled in the connector tentative coupling process, as shown in FIG. 5, the weld fixing portions 54, 55 of the slit outer blade 40 are each welded to the corresponding one of the welding portions 95, 96 of the outer blade connectors 90. Thus, when the comb component 60 is held between the slit outer blade 40 and the outer blade connectors 90, the slit outer blade 40 is fixed to the outer blade connectors 90. This prevents or limits movement of the comb component 60 in the widthwise direction ZA, the depth direction ZB, and the heightwise direction ZC relative to the slit outer blade 40 and the outer blade connectors 90. In the fixing process, the welding portions 114 of the inner blade connector 110 are welded to the weld fixing portions 105 of the slit inner blade 100.

The operation of the electric razor 1 will now be described with reference to FIGS. 5 and 7 to 9.

In the slit blade block 30, when the comb component 60 is held between the slit outer blade 40 and the outer blade connectors 90, the slit outer blade 40 is fixed to the outer blade connectors 90. More specifically, the comb component 60 is held between the slit outer blade 40 and the outer blade connectors 90 as follows.

The comb component 60 is held between the links 43 of the slit outer blade 40 and the seats 92 of the outer blade connectors 90 in the heightwise direction ZC at the projections 83. The comb component 60 is held between the links 43 of the slit outer blade 40 and projections 93 of the outer blade connectors 90 in the widthwise direction ZA at the comb end walls 80. This prevents or limits changes in the position of the comb component 60 relative to the slit outer blade 40 and the outer blade connectors 90 in the heightwise direction ZC and the widthwise direction ZA.

Additionally, in the heightwise direction ZC, the size of the comb component 60 is smaller than the size of each of the weld fixing portions 54, 55 of the slit outer blade 40. Thus, the weld fixing portions 54, 55 and the welding portions 95, 96 of the outer blade connectors 90 project downward beyond the lower surfaces 71A of the comb component 60 and thus are exposed from the comb component 60. A coupling operator can see the weld fixing portions 54, 55 and the welding portions 95, 96 from an outer side of the slit blade block 30. Thus, the weld fixing portions 54, 55 and the welding portions 95, 96 may be easily heat-sealed.

A decrease in the size of the comb component 60 in the heightwise direction ZC would lower the rigidity of the comb component 60. If such an electric razor 1 is used, when an external force is applied to the comb walls 70 through the comb teeth 72, the comb walls 70 would be deformed in a relatively large manner. In this regard, the electric razor 1 of the present embodiment has a structure in which the comb component 60 and the slit outer blade 40 are coupled as follows. More specifically, the first claws 51 of the slit outer blade 40 are accommodated in the first receptacles 74 of the comb component 60. The second claws 52 of the slit outer blade 40 are accommodated in the second receptacles 75. The fitting portions 53 of the slit outer blade 40 are fitted to the positioning portions 76 of the comb component 60. When a comb wall 70 of the comb component 60 receives an external force directed outward in the depth direction ZB, the fittings of the first claws 51 with the first receptacles 74 and the second claw 52 with the second receptacle 75 prevent or limit an outward deformation, in the depth direction ZB, of the comb wall 70. Therefore, in the slit blade block 30, the comb component 60 may be thinned while a deformation of the comb component 60 is limited.

The slit blade block 30 includes the first claws 51, which are separated from one another in the widthwise direction ZA, and the first receptacles 74, which are separated from one another in the widthwise direction ZA. This prevents or limits an outward deformation, in the depth direction ZB, of a comb wall 70 over a wide area of the comb wall 70.

When a comb wall 70 of the comb component 60 receives a downward external force, the fitting portions 53 contact the comb wall 70. This prevents or limits a downward deformation of the comb wall 70. Therefore, in the slit blade block 30, the comb component 60 may be thinned while a downward deformation of the comb component 60 is limited.

Additionally, the slit blade block 30 includes the fitting portions 53, which are separated from one another in the widthwise direction ZA, and the positioning portions 76, which are separated from one another in the widthwise direction ZA. This prevents or limits a downward deformation of a comb wall 70 over a wide area, in the widthwise direction ZA, of the comb wall 70.

The electric razor 1 of the present embodiment has the advantages described below.

(1) The comb component 60 is held between the slit outer blade 40 and the outer blade connectors 90. In this situation, the slit outer blade 40 is fixed to the outer blade connectors 90. This fixes the comb component 60 to the slit outer blade 40 and the outer blade connectors 90. This structure prevents or limits changes in the position of the comb component 60 relative to the slit outer blade 40 and the outer blade connectors 90 in a direction in which the comb component 60 is sandwiched between the slit outer blade 40 and the outer blade connectors 90. Thus, the slit outer blade 40, the comb component 60, and the outer blade connectors 90 are fixed in a stable manner compared to the conventional slit blade block 200.

(2) The weld fixing portions 54, 55 of the slit outer blade 40 and the welding portions 95, 96 of the outer blade connectors 90 are each exposed downward from the lower surfaces 71A of the comb wall bodies 71 of the comb component 60. This structure facilitates the task for welding the slit outer blade 40 and the outer blade connectors 90. Additionally, the welds of the weld fixing portions 54, 55 and the welding portions 95, 96 may be visually checked.

(3) In the comb component 60, the comb end walls 80 are opposed to the links 43 of the slit outer blade 40 with slight gaps located in between in the widthwise direction ZA. In the comb component 60, the receptacles 82 of the comb end walls 80 are opposed to the projections 93 of the outer blade connectors 90 with slight gaps located in between in the widthwise direction ZA. In this structure, the comb component 60 is held between the slit outer blade 40 and the outer blade connectors 90 in the widthwise direction ZA in addition to the heightwise direction ZC. This prevents or limits changes in the relative position of the slit outer blade 40 and the comb component 60 in the widthwise direction ZA.

(4) The comb component 60 is held between the links 43 of the slit outer blade 40 and the seats 92 of the outer blade connectors 90 at the projections 83. When the slit bodies 50 are inserted into the insertion portions 61 of the comb component 60, the slit outer blade 40 is inserted in the comb component 60. In this structure, when the slit outer blade 40, the comb component 60, and the outer blade connectors 90 are stacked, the slit blade block 30 is tentatively coupled. Thus, the slit blade block 30 is easily tentatively coupled.

(5) The comb component 60 includes the first receptacles 74, which engage the first claws 51 of the slit outer blade 40. In this structure, when a comb wall 70 receives a force directed outward in the depth direction ZB, the first claws 51 contact the first receptacles 74. This prevents or limits an outward deformation of the comb wall 70 in the depth direction ZB.

(6) The comb component 60 includes the second receptacles 75, which engage the second claws 52 of the slit outer blade 40. In this structure, when a comb wall 70 receives a force directed outward in the depth direction ZB, the second claw 52 contacts the second receptacle 75. This prevents or limits an outward deformation of the comb wall 70 in the depth direction ZB.

(7) The fitting portions 53 of the slit outer blade 40 are fitted to the positioning portions 76 of the comb component 60. This structure prevents or limits movement of the comb walls 70 relative to the slit outer blade 40 in the heightwise direction ZC.

(8) In the comb component 60, in the depth direction ZB, the thickness T1 of two opposite ends, in the widthwise direction ZA, of each comb wall 70 is greater than the thickness T2 of the middle, in the widthwise direction ZA, of the comb wall 70. This improves the rigidity of the comb component 60. Additionally, when the desirable rigidity of the comb component 60 has been obtained by increasing the thickness T1 of the comb wall bodies 71, the thickness T2 of the middle, in the widthwise direction ZA, of the comb wall bodies 71 may be reduced.

(9) In the depth direction ZB, size G1 of each insertion portion 61 of the comb component 60 is greater than the size of a slit body 50 of the slit outer blade 40. In this structure, the slit outer blade 40 may be easily inserted into the comb component 60. For example, when a comb wall 70 is bent outward in the depth direction ZB, the insertion portions 61 prevent or limit interference of two opposite ends, in the widthwise direction ZA, of the comb wall 70 with the links 43 of the slit outer blade 40. Additionally, when the slit outer blade 40 is coupled to the comb component 60, the bending of the comb walls 70 is prevented or limited in the depth direction ZB.

(10) The weld fixing portions 105 of the slit inner blade 100 and the welding portions 114 of the inner blade connector 110 project downward beyond the lower surfaces 71A of the comb wall bodies 71 of the comb component 60. This structure facilitates the task for welding the slit inner blade 100 and the inner blade connector 110. Additionally, the welds of the weld fixing portions 105 and the welding portions 114 may be visually checked.

The embodiment may be modified as follows. Modified examples may be combined.

The slit outer blade 40 of the embodiment may exclude at least one of a first claw 51, a second claw 52, and a fitting portion 53.

In the slit outer blade 40 of the embodiment, each slit body 50 includes two first weld fixing portions 54. However, the number of the first weld fixing portions 54 is not limited to that illustrated in the embodiment. In the slit outer blade 40, the number of the first weld fixing portions 54 in each slit body 50 may be less than two, or three or greater. The second weld fixing portions 55 may be modified in the same manner.

In the slit outer blade 40 of the embodiment, each slit body 50 includes four fitting portions 53. However, the number of the fitting portions 53 is not limited to that illustrated in the embodiment. In the slit outer blade 40, the number of the fitting portions 53 in each slit body 50 may be one, two, three, or five or greater.

In the slit outer blade 40 of the embodiment, each slit body 50 includes four first weld fixing portions 54. However, the number of the first weld fixing portions 54 is not limited to that illustrated in the embodiment. In the slit outer blade 40, the number of the first weld fixing portions 54 in each slit body 50 may be three or less or five or greater. The second weld fixing portions 55 may be modified in the same manner.

The comb component 60 of the embodiment is formed from a resin material. However, the material of the comb component 60 is not limited to that illustrated in the embodiment. For example, a modified example of the comb component 60 is formed from a metallic material.

In the comb component 60 of the embodiment, each comb wall 70 may exclude at least one of a first receptacle 74, a second receptacle 75, and a positioning portion 76.

In the comb component 60 of the embodiment, each comb wall 70 includes four first receptacles 74 and one second receptacle 75. However, the number of each of the first receptacles 74 and the second receptacles 75 is not limited to that illustrated in the embodiment. In the comb component 60, the number of the first receptacles 74 in each comb wall 70 may be one, two, three, or five or greater. In the comb component 60, each comb wall 70 may include a plurality of second receptacles 75.

The structure of the comb component 60 is not limited to that illustrated in the embodiment. For example, the comb teeth 72 may be arranged on only one of the comb walls 70.

Also, some of the comb teeth 72 may be omitted. For example, one of the comb walls 70 may be omitted.

Preferably, the thickness T1 of two opposite ends, in the widthwise direction ZA, of each comb wall 70 is greater than the thickness T2 of the middle, in the widthwise direction ZA, of the comb wall 70. However, the proportion of the comb wall 70 is not limited to that illustrated in the embodiment. For example, the thickness T1 of the two opposite ends of each comb wall 70 may be the same as the thickness T2 of the middle of the comb wall 70.

Each outer blade connector 90 of the embodiment may exclude at least one of the projection 93 and the accommodation hole 94.

The outer blade connector 90 of the embodiment includes two first welding portions 95. However, the number of the first welding portions 95 is not limited to that illustrated in the embodiment. The number of the first welding portions 95 in the outer blade connector 90 may be less than two, or three or more. The second welding portions 96 may be modified in the same manner.

Figure 10:
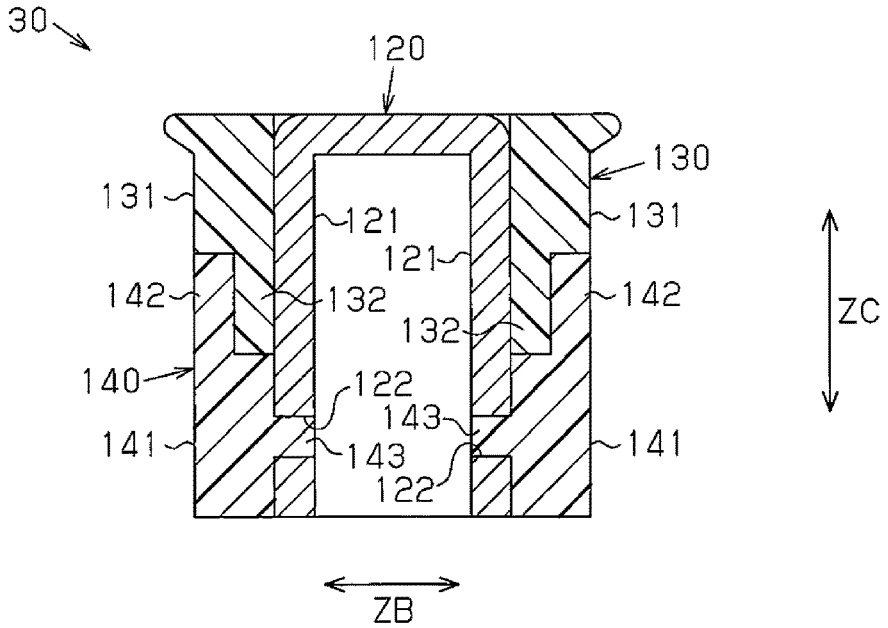
FIG. 10 is a schematic cross-sectional view of a modified example of a slit blade block.
Figure 11:
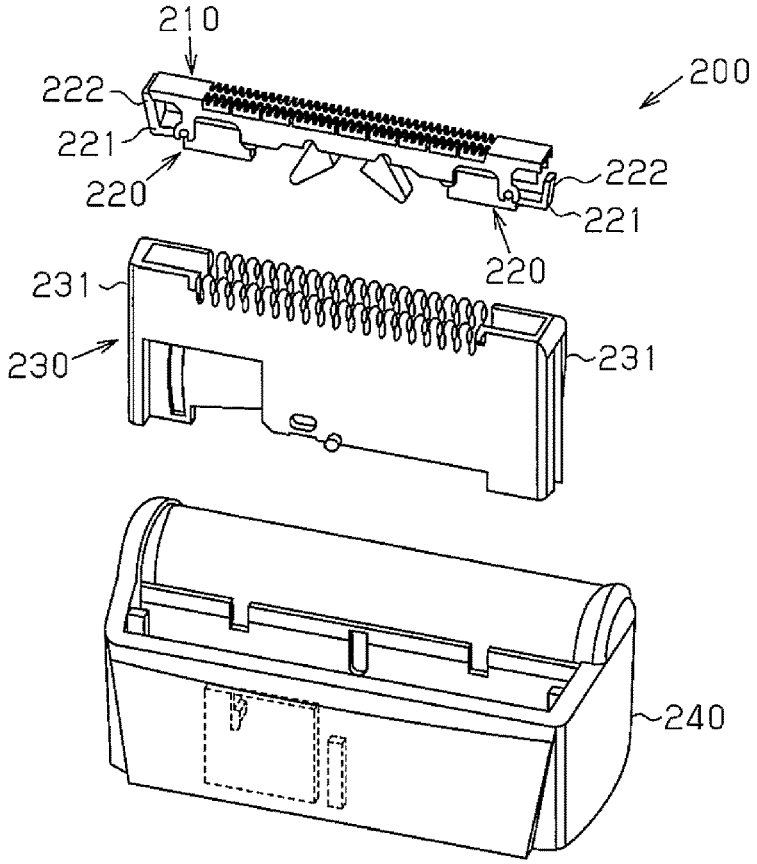
FIG. 11 is an exploded perspective view of a conventional slit blade block.
Figure 12:
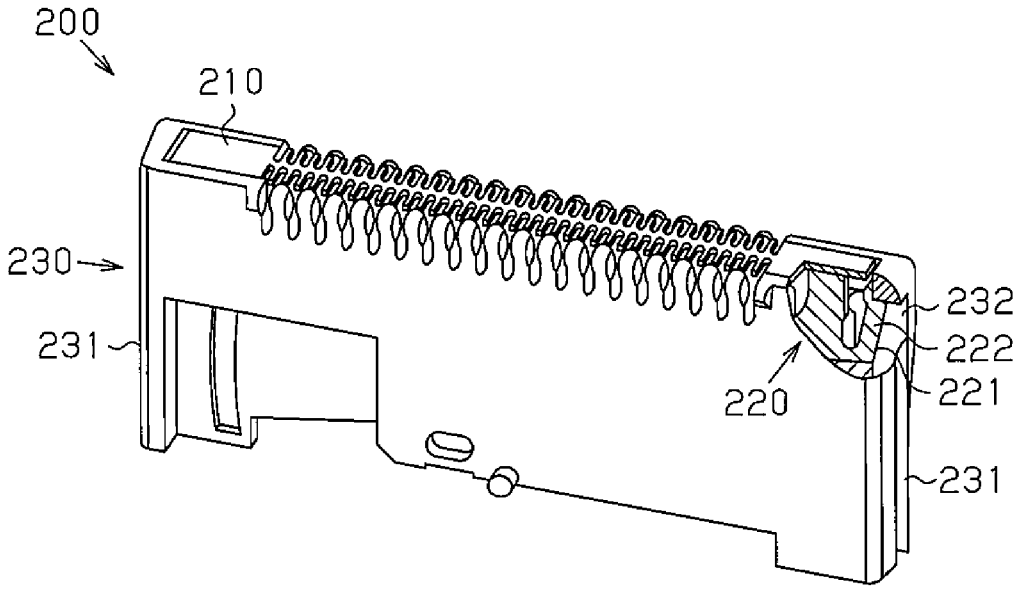
FIG. 12 is a partially cut-away perspective view of the conventional slit blade block.

The slit blade block 30 of the present embodiment is held between the slit outer blade 40 and the outer blade connectors 90 at the projections 83 of the comb component 60. The connection structure of the slit blade block 30 is not limited to that illustrated in the embodiment. For example, FIG. 10 shows a modified example of the slit blade block 30. As shown in FIG. 10, a comb component 130 is held between a slit outer blade 120 and an outer blade connector 140 in the depth direction ZB.

More specifically, the comb component 130 includes comb walls 131. Each comb wall 131 includes a fitting portion 132 at a lower side. The slit outer blade 120 includes slit bodies 121. Each slit body 121 includes a weld fixing portion 122 at a lower side. The outer blade connector 140 includes connector bodies 141. Each connector body 141 includes a fitting portion 142 formed at an upper side and a welding portion 143 formed at a lower side. The slit blade block 30 of the modified example is held, at the fitting portions 132 of the comb component 130, between the slit bodies 121 of the slit outer blade 120 and the fitting portions 142 of the outer blade connectors 140 in the depth direction ZB. In this situation, the welding portions 143 of the outer blade connectors 140 are located in the weld fixing portions 122 of the slit outer blade 120. Then, the welding portions 143 are welded to the weld fixing portions 122 by heat sealing. Each weld fixing portion 122 corresponds to a slit fixing portion. Each welding portion 143 corresponds to a connector fixing portion.

In the slit blade block 30 of the modified example, the slit outer blade 120 may additionally include a fitting portion that corresponds to the fitting portion 53 of the slit outer blade 40. Also, in the slit blade block 30 of the modified example, the comb component 130 may additionally include a positioning portion that corresponds to the positioning portion 76 of the comb component 60. In such an additional structure, the comb component 130 is fitted to the fitting portion of the slit outer blade 120 using the positioning portion. This prevents or limits upward movement of the comb component 130 from the slit outer blade 120.

In the slit blade block 30 of the embodiment, after the slit outer blade 40 and comb component 60 are tentatively coupled, an assembly of the slit outer blade 40 and the comb component 60 is tentatively coupled to the outer blade connectors 90. However, the tentative coupling process of the slit blade block 30 is not limited to that illustrated in the embodiment. For example, in a modified example of the slit blade block 30, after the comb component 60 and the outer blade connectors 90 are tentatively coupled, an assembly of the comb component 60 and the outer blade connectors 90 is tentatively coupled to the slit outer blade 40.

In the slit blade block 30 of the embodiment, the slit outer blade 40 includes the first claws 51. The comb component 60 includes the first receptacles 74. However, the structure of the slit blade block 30 is not limited to that illustrated in the embodiment. For example, in a modified example of the slit blade block 30, the slit outer blade 40 includes the first receptacles 74. The comb component 60 includes the first claws 51. The second claws 52 of the slit outer blade 40 and the second receptacles 75 of the comb component 60 may be modified in the same manner.

In the slit blade block 30 of the embodiment, the slit outer blade 40 includes the fitting portions 53. The comb component 60 includes the positioning portions 76. However, the structure of the slit blade block 30 is not limited to that illustrated in the embodiment. For example, in a modified example of the slit blade block 30, the slit outer blade 40 includes the positioning portions 76. The comb component 60 includes the fitting portions 53.

In the slit blade block 30 of the embodiment, in the fixing process, the weld fixing portions 54, 55 of the slit outer blade 40 are welded to the welding portions 95, 96 of the outer blade connectors 90 by heat sealing. However, the fixing structure of the slit outer blade 40 and the outer blade connectors 90 is not limited to that illustrated in the example. For example, in a modified example of the slit blade block 30, the slit outer blade 40 is fixed to the outer blade connectors 90 by bonding. Thus, a fixing process other than heat sealing may be used as long as the slit outer blade 40 can be fixed to the outer blade connectors 90.

The slit blade block 30 of the embodiment is configured so that the slit inner blade 100 reciprocally moves relative to the slit outer blade 40. The structure of the slit blade block 30 is not limited to that illustrated in the embodiment. For example, a modified example of the slit blade block 30 may have a rotary structure in which the slit inner blade 100 rotates relative to the slit outer blade 40.

The blade unit 20 of the embodiment includes two first blade blocks 21, two second blade blocks 24, and the slit blade block 30. However, the structure of the blade unit 20 is not limited to that illustrated in the embodiment. For example, at least one of the first blade blocks 21 and the second blade blocks 24 may be omitted. In another modified example, the blade unit 20 includes one first blade block 21, one second blade block 24, and the slit blade block 30. In a further modified example, the blade unit 20 includes the slit blade block 30 and one of a first blade block 21 and a second blade block 24.

The electric razor 1 of the embodiment is of a reciprocal motion type in which the first inner blades 23, the second inner blades 26, and the slit inner blade 100 reciprocally move. However, the electric razor 1 is not limited to that illustrated in the embodiment. For example, the electric razor 1 may be of a rotary type in which the inner blades 23, 26 and the slit inner blade 100 rotate.

The electric razor 1 of the embodiment is configured to remove whiskers (hair). However, the electric razor 1 may be applied to an area other than that illustrated in the embodiment. For example, a modified example of the electric razor 1 may be a face shaver, which is configured to remove hair other than whiskers, such as eyebrows. Another modified example of the electric razor 1 may be a body shaver, which is configured to remove hair on body parts other than a face.

The above description is to be considered as illustrative and not restrictive. The components disclosed in the embodiments may be assembled in any combination for embodying the present invention. For example, some of the components may be omitted from all components disclosed in the embodiments.

The invention claimed is:

1. A slit blade block of an electric razor, the slit blade block comprising:

a slit outer blade including a plurality of blade pieces;

a comb component, which is a stationary component relative to the slit outer blade, including a plurality of comb teeth adjacent to the blade pieces; and an outer blade connector, to which the slit outer blade is fixed, wherein the slit outer blade, the comb component, and the outer blade connector are separate components, and wherein the comb component is rectangular frame-shaped as viewed in a plan view of the slit blade block and is elongated in a widthwise direction of the slit blade block, wherein the comb component includes comb end walls at opposing ends of the comb component in the widthwise direction of the slit blade block, the comb end walls each extending in a depth direction of the slit blade block, wherein a projection is formed on each of the comb end walls, the projection projecting inwardly from the corresponding comb end wall in the widthwise direction of the slit blade block, wherein when the slit outer blade, the comb component, and the outer blade connector are assembled to form the slit blade block, the projections formed on the comb end walls of the comb component are clamped by and sandwiched between a first surface of the slit outer blade and a second surface of the outer blade connector in a heightwise direction with the slit outer blade fixed to the outer blade connector, and wherein the first surface of the slit outer blade presses the projections formed on the comb end walls of the comb component against the second surface of the outer blade connector in the heightwise direction in such a manner that the comb component is immovable relative to the slit outer blade and the outer blade connector in the heightwise direction.

2. The slit blade block according to claim 1, wherein:

the slit outer blade includes a slit fixing portion;

the outer blade connector includes a connector fixing portion, wherein the connector fixing portion is coupled to the slit fixing portion of the slit outer blade so that the slit outer blade is fixed to the outer blade connector; and the slit fixing portion and the connector fixing portion are located below a lower end surface of the comb component.

3. The slit blade block according to claim 1, wherein the blade pieces are laid out in a layout direction, and the comb component is held between the slit outer blade and the outer blade connector in the layout direction and a heightwise direction.

4. The slit blade block according to claim 1, wherein the blade pieces are laid out in a layout direction, and the comb component is held between the slit outer blade and the outer blade connector in the layout direction and a depth direction that is orthogonal to the layout direction.

5. An electric razor comprising:

the slit blade block according to claim 1.

* * * * *